United States Patent [19]

Gilbu

[11] 4,071,161

[45] Jan. 31, 1978

[54] CYLINDRICAL UNDERGROUND STORAGE TANK HAVING PARTICULARLY SHAPED END CAPS

[75] Inventor: Agnar Gilbu, Sandefjord, Norway

[73] Assignee: Owens-Corning Fiberglas Corporation, Toledo, Ohio

[21] Appl. No.: 755,752

[22] Filed: Dec. 30, 1976

[51] Int. Cl.[2] ..... B65D 89/06; B65D 7/46

[52] U.S. Cl. ..... 220/18; 220/1 B; 220/72; 220/83

[58] Field of Search ..... 220/1 B, 3, 18, 72, 220/83; 61/.5

[56] References Cited

U.S. PATENT DOCUMENTS

| | | | |
|---|---|---|---|
| 2,289,913 | 7/1942 | Joor, Jr. | 220/1 B |
| 3,412,891 | 11/1968 | Balstone et al. | 220/3 X |
| 3,461,009 | 8/1969 | Snyder et al. | 220/3 X |

*Primary Examiner*—Stephen Marcus

*Attorney, Agent, or Firm*—R. C. Hudgens; P. J. Rose; P. P. Pacella

[57] ABSTRACT

End caps of the tank are generally spherical adjacent the axis of the tank and frusto-conical adjacent the circumference of the tank to eliminate voids normally occurring in the backfill under fully hemispherical end caps.

6 Claims, 3 Drawing Figures

CYLINDRICAL UNDERGROUND STORAGE TANK HAVING PARTICULARLY SHAPED END CAPS

Horizontally extending cylindrical underground storage tanks of glass fiber reinforced plastic are generally provided with hemispherical end caps to enclose the largest volume per unit of surface area of the end cap and permit thinner walls than when flat end caps are used. Sand and gravel normally used as backfill around such tanks has an angle of repose of about forty degrees. This frequently results in a void beneath an end cap. The lack of support at the void frequently results in tank failure in the cylindrical part of the tank adjacent the end cap due to bending moments caused by the weights of the end cap, the liquid in the end cap, and the earth above the end cap.

In accordance with this invention, the end caps are made frusto-conical where they join the cylindrical shell of the tank, with an angle of about 45° from the axis of the tank, while being maintained generally spherical at their central portions adjacent the tank axis. With such a construction, voids due to the natural angle of repose of backfill material do not occur under the end caps where they join the cylindrical shell of the tank. With full support of the end caps, tank failures are reduced.

Accordingly, it is an object of this invention to provide a horizontally extending cylindrical storage tank of glass fiber reinforced plastic for underground use having end caps generally spherical at their central portions for enclosing relatively large volumes per unit area and generally frusto-conical at their peripheries for eliminating voids in backfill material otherwise likely to occur under fully hemispherical end caps.

Figure 1:
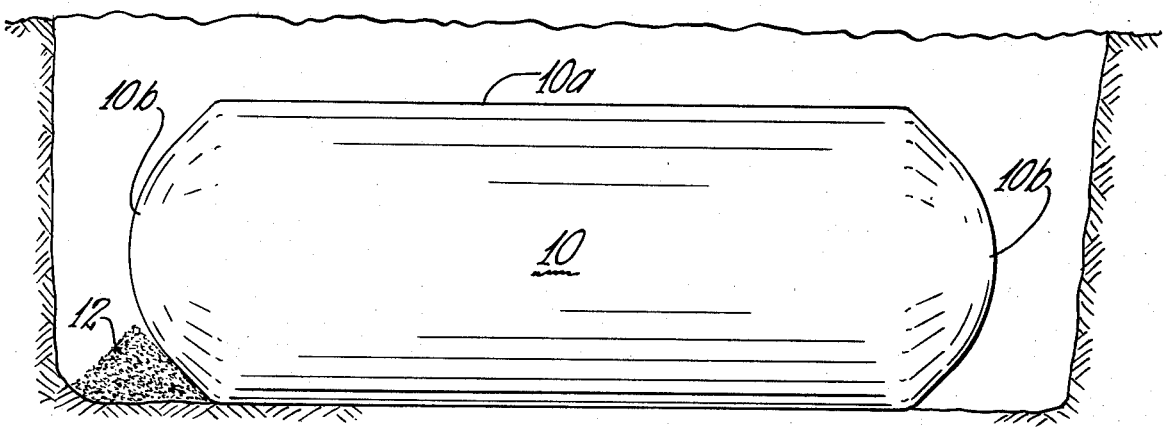
FIG. 1 is a front elevational view of a tank constructed in accordance with the invention and disposed below ground level, only a portion of the backfill adjacent one end being shown.

With respect to the drawings, FIG. 1 shows a horizontally extending cylindrical underground storage tank 10 constructed in accordance with the invention. The tank 10 is made of glass fiber reinforced plastic and includes a cylindrical body or shell **10*a* and a pair of end caps 10*b*. One end cap 10*b* and a portion of the body 10*a* are shown more clearly in FIG. 2**.

Proper installation of reinforced plastic tanks is at least as important as proper design of the tanks. Use is made of the strength imparted by the surrounding earth in order to avoid having to make the walls of the tanks thicker, which would make them too costly and too heavy for convenient handling. In order to insure proper support from the surrounding earth, sand and gravel are normally used as backfill.

Figure 2:
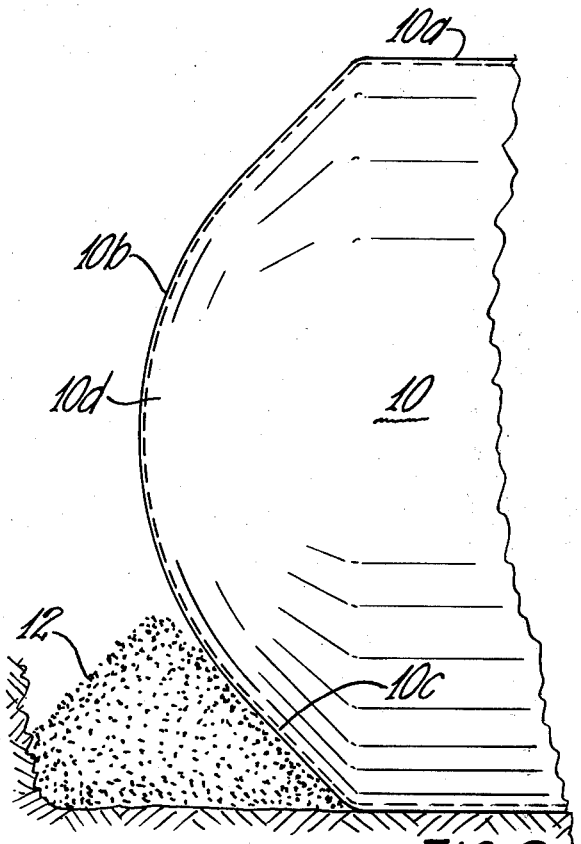
FIG. 2 is an enlarged fragmentary elevational view of a left-hand end portion of FIG. 1.

Backfill material 12 is shown adjacent the left-hand end of the tank 10 in FIGS. 1 and 2. The small amount of backfill material 12 shown illustrates the advantage of applicant's invention, it being understood that backfill material is used all around the tank.

Figure 3:
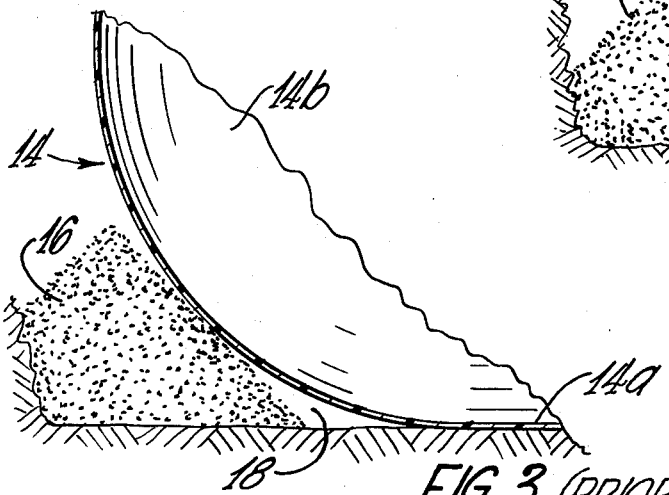
FIG. 3 (PRIOR ART)
FIG. 3 is a fragmentary sectional view similar to FIG. 2 but showing a tank having a hemispherical end cap.

The natural angle of repose of sand and gravel is about 40°. In FIG. 3 a portion of a tank 14 having a cylindrical body **14*a* and a hemispherical end cap 14*b* is shown with backfill material 16. Because of the natural angle of repose of the sand or gravel 16 and the hemispherical shape of the end cap 14*b*, a void 18 occurs beneath the end cap, and this void normally remains after backfilling to ground level. Failure of the tank body 14*a* thus is likely to occur at the bottom thereof a short distance from its junction with the end cap 14*b***.

In the tank 10 of FIGS. 1 and 2, constructed in accordance with the invention, the end caps **10*b* are generally conically shaped adjacent their peripheries where they join the tank body 10*a*, a frusto-conical portion 10*c* of the end cap 10*b* of FIG. 2 being provided with an angularity of from 35° to 45°, preferably 45°, from the axis of the tank body 10*a*. An angularly of forty-five degrees insures that there will never be a void under the end cap due to the natural angle of repose of the sand or gravel. At the same time, a generally spherical central portion 10*d* is provided on the end cap 10*b* to substantially retain all the advantages of a hemispherical end cap such as the end cap 14*b* of FIG. 3**. The volume of the tank is increased if the tank body is made longer to meet the frusto-conical portion of the end cap.

The tank bodies are preferably made by applying resin, chopped glass fibers, and continuously wound glass filaments on a recirculating helical band mandrel surface such as disclosed in U.S. Pat. Nos. 3,464,879; 3,655,489; and 3,679,521. The end caps are made by spraying resin and chopped glass fibers on a revolving mold surface in a manner such as disclosed in U.S. Pat. No. 3,904,339. End caps are joined to tank bodies by known methods. The tank bodies may be provided with axially spaced circumferential reinforcing ribs on their outer surfaces as disclosed in U.S. Pat. No. 3,661,294, which is hereby incorporated by reference.

Various modifications may be made in the structure shown and described without departing from the spirit and scope of the invention.

I claim:

1. A cylindrical storage tank formed of glass fiber reinforced plastic and adapted to be installed underground in a horizontally extending position, the tank comprising a hollow cylindrical body and two end caps joined respectively to opposite end portions of the cylindrical body, the end caps being outwardly convex and generally spherical at their central portions but being frusto-conical adjacent their junctions with the cylindrical body, the radius of curvature of the spherical portions being substantially equal to what it would be for completely hemispherical end caps corresponding in radius to the radius of the cylindrical body and the frusto-conical portion of each end cap forming an angle adjacent the bottom of the tank with an underground support surface when the tank is installed horizontally underground, said angle substantially corresponding to the natural angle of repose of recommended backfill material such as sand or gravel, whereby voids otherwise likely to occur beneath the end caps if the end caps were completely hemispherical are eliminated.

2. A tank as claimed in claim 1 wherein the tank body is provided on its outer surface with axially spaced circumferential reinforcing ribs.

3. A tank as claimed in claim 1 wherein the frusto-conical portions of the end caps extend at an angle of from 35° to 45° with respect to the axis of the cylindrical body.

4. A tank as claimed in claim 1 wherein the frusto-conical portions of the end caps extend at an angle of about forty degrees with respect to the axis of the cylindrical body.

5. A tank as claimed in claim 1 wherein the frustoconical portions of the end caps extend at an angle of about 45° with respect to the axis of the cylindrical body.

6. A tank as claimed in claim 1 wherein the frustoconical portion of each end cap is tangent to the spherical portion.

* * * * *